US011499801B1

(12) United States Patent
Chen

(10) Patent No.: US 11,499,801 B1
(45) Date of Patent: Nov. 15, 2022

(54) FIREARM SAFE BOX WITH SLIDE OPENING CONTAINER

(71) Applicant: Vaultek Safe Inc., Orlando, FL (US)

(72) Inventor: Shixiong Chen, Columbia, SC (US)

(73) Assignee: Vaultek Safe Inc., Orlando, FL (US)

( * ) Notice: Subject to any disclaimer, the term of this patent is extended or adjusted under 35 U.S.C. 154(b) by 319 days.

(21) Appl. No.: 16/903,024

(22) Filed: Jun. 16, 2020

Related U.S. Application Data

(60) Provisional application No. 62/874,733, filed on Jul. 16, 2019.

(51) Int. Cl.

| | |
|---|---|
| ***F41C 33/06*** | (2006.01) |
| ***E05B 65/00*** | (2006.01) |
| ***G07C 9/00*** | (2020.01) |
| ***E05B 65/52*** | (2006.01) |
| ***E05F 1/16*** | (2006.01) |
| ***G07C 9/37*** | (2020.01) |

(52) U.S. Cl.
CPC ..... *F41C 33/06* (2013.01); *E05B 65/0075* (2013.01); *E05B 65/5246* (2013.01); *E05F 1/16* (2013.01); *G07C 9/00563* (2013.01); *G07C 9/00912* (2013.01); *G07C 9/37* (2020.01); *E05Y 2900/602* (2013.01)

(58) Field of Classification Search
CPC .. Y10T 70/5031; F41C 33/06; E05B 65/0075; E05B 65/5246; E05F 1/16; G07C 9/00563; G07C 9/00912; G07C 9/37; E05G 1/00; E05G 1/005; E05G 1/02; E05G 1/024; E05G 1/026; E05G 1/04; E05G 2700/00; E05G 2700/02
USPC ..... 109/47, 50–52; 211/64; 206/317; 42/70.11; 248/551–553; 224/912, 913
See application file for complete search history.

(56) References Cited

U.S. PATENT DOCUMENTS

| | | | | |
|---|---|---|---|---|
| 4,895,008 | A * | 1/1990 | Blake | E05B 47/0607 312/319.1 |
| 4,941,718 | A * | 7/1990 | Alexander, III | G01S 13/931 296/37.7 |
| 5,111,755 | A * | 5/1992 | Rouse | E05G 1/00 109/47 |
| 5,806,439 | A * | 9/1998 | Fitts, Sr. | G07F 19/201 109/24.1 |
| 6,570,501 | B2 | 5/2003 | Bushnell et al. | |
| 6,843,081 | B1 * | 1/2005 | Painter | F41C 33/06 42/70.11 |

(Continued)

OTHER PUBLICATIONS

"Vaultek Introduces the Slider Series" video, uploaded Aug. 6, 2018 at https://www.youtube.com/watch?v=hRrPZbC-WL4.

*Primary Examiner* — Lloyd A Gall
(74) *Attorney, Agent, or Firm* — Nelson Mullins Riley & Scarborough LLP

(57) ABSTRACT

A firearm safe box comprising a housing having sides defining an interior volume and an opening. A container is slidably received in the opening of the housing, the container being movable between a closed position preventing access to the container and an open position allowing access to the container. In this embodiment, the container carries a configured insert adapted to cradle a firearm. A lock mechanism is operative to retain the container in the closed position. An opening mechanism is operative to automatically move the container to the open position when the lock mechanism is released.

21 Claims, 9 Drawing Sheets

(56) References Cited

U.S. PATENT DOCUMENTS

| | | | | |
|---|---|---|---|---|
| 7,178,370 | B2 * | 2/2007 | Engel | G07C 9/37 109/51 |
| 8,186,188 | B1 * | 5/2012 | Brown | E05G 1/005 109/45 |
| 9,218,699 | B1 | 12/2015 | McIntyre et al. | |
| 9,963,927 | B1 * | 5/2018 | Dudley | E05G 1/026 |
| 10,253,529 | B1 | 4/2019 | McGinn | |
| 11,078,713 | B1 * | 8/2021 | Baker | E05G 1/02 |
| 2002/0124779 | A1 * | 9/2002 | Perkins | E05G 1/00 109/47 |
| 2003/0183136 | A1 * | 10/2003 | Perkins | E05G 1/00 109/47 |
| 2011/0247950 | A1 | 10/2011 | Mcgee | |
| 2013/0134193 | A1 | 5/2013 | Mothersele | |
| 2013/0229098 | A1 | 9/2013 | Pletcher | |
| 2015/0033994 | A1 * | 2/2015 | Popwell | E05G 1/10 109/43 |
| 2019/0226267 | A1 * | 7/2019 | Batdorf, III | E05G 1/026 |
| 2019/0251799 | A1 * | 8/2019 | Mochizuki | G07F 19/205 |

* cited by examiner

FIREARM SAFE BOX WITH SLIDE OPENING CONTAINER

PRIORITY CLAIM

This application claims the benefit of U.S. provisional application Ser. No. 62/874,733, filed Jul. 16, 2019, which is relied upon herein and incorporated fully herein by reference for all purposes.

FIELD OF THE INVENTION

Example embodiments generally relate to firearm safe boxes, and, in particular, to a firearm safe box having a container that slides open automatically when released.

BACKGROUND OF THE INVENTION

Safe boxes are used to store items so that only a select individual or group of individuals can access the items. Safe boxes are commonly locked with key, combination, or biometric (e.g., fingerprint) locks. In order to prevent unwanted removal, safe boxes are often mounted directly to a surface, such as, for example, a wall, desk, or the like. For example, a handgun safe may be mounted to a surface to store a handgun in a secure manner. When the owner of the handgun needs to access it for reasons such as personal protection, the owner unlocks the safe and retrieves the weapon. An example safe box is shown and described in U.S. Pat. No. 10,253,529, issued Apr. 9, 2019, incorporated herein by reference in its entirety.

SUMMARY OF THE INVENTION

The present invention recognizes and addresses the foregoing considerations, and others, of prior art constructions and methods.

One aspect of the present invention provides a firearm safe box comprising a housing having sides defining an interior volume and an opening. A container is slidably received in the opening of the housing, the container being movable between a closed position preventing access to the container and an open position allowing access to the container. In this embodiment, the container carries a configured insert adapted to cradle a firearm. A lock mechanism is operative to retain the container in the closed position. An opening mechanism is operative to automatically move the container to the open position when the lock mechanism is released.

In exemplary embodiments, the opening mechanism may comprise at least one rotary gear driven by an energy storage element. For example, the at least one rotary gear may comprise a plurality of rotary gears forming a gear set. The energy storage element, for example, may comprise a torsion spring coaxial with one of the plurality of rotary gears.

In exemplary embodiments, the opening mechanism further comprises a gear rack engaging the at least one rotary gear. For example, the gear rack may be fixed with respect to the housing and the at least one gear is connected to the container for movement with respect thereto. The opening mechanism may further comprise a guide track extending parallel to the gear rack, the guide track being engaged by a follower connected to the container for movement therewith. The guide track may comprise an elongate rod and the follower may include a cylindrical bushing slidable along the elongate rod. At least one roller may be connected to the container for movement therewith, the roller engaging and rolling along a fixed surface. In such embodiments, the at least one roller and said gear rack may be mounted on opposite lateral sides of the track.

In exemplary embodiments, the lock mechanism comprises a striker mounted to the container and a rotatable latch mounted in a fixed position relative to the container. For example, the lock mechanism may be releasable by at least one of a numeric combination, biometric validation, or a key lock.

A further aspect of the present invention provides a firearm safe box comprising a housing defining a back side, a top side, a bottom side, a left side, and a right side of the safe box. The housing further defines an opening in which a container is slidably received, the container being movable between a closed position preventing access to the container and an open position allowing access to the container, the container defining a front side of the safe box when in the closed position. A lock mechanism is operative to retain the container in the closed position. An opening mechanism is operative to automatically move the container to the open position when the lock mechanism is released, the opening mechanism including at least one rotary gear driven by an energy storage element and a gear rack engaged the at least one rotary gear.

Further aspects of the present invention may be discerned from the description herein. The accompanying drawings, which are incorporated in and constitute a part of this specification, illustrate one or more embodiments of the present invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
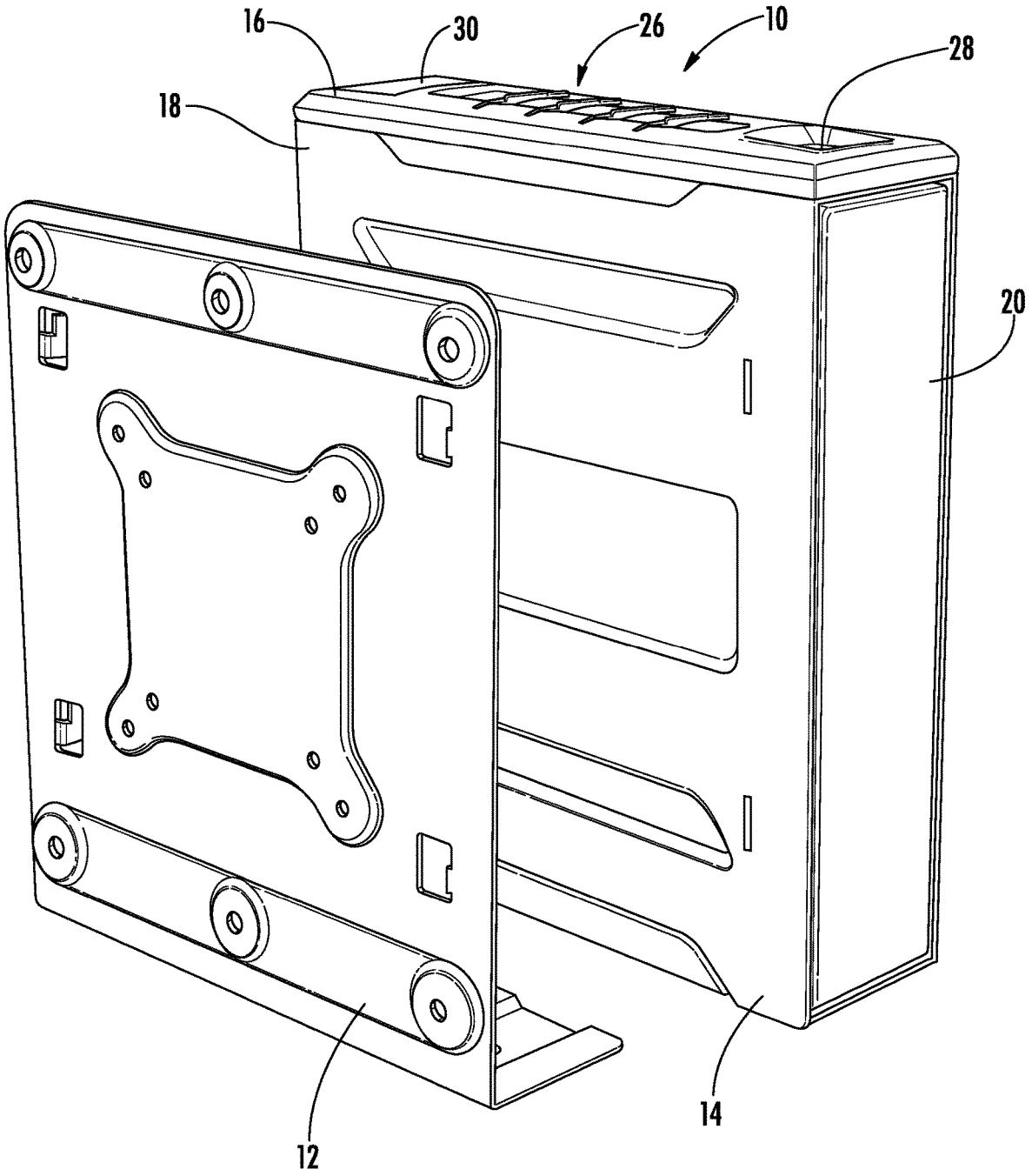
FIG. 1 is a perspective view of a safe box in accordance with an embodiment of the present invention and its mounting plate.

Repeat use of reference characters in the present specification and drawings is intended to represent same or analogous features or elements of the invention according to the disclosure.

DESCRIPTION OF PRESENTLY PREFERRED EMBODIMENTS

Some example embodiments now will be described more fully hereinafter with reference to the accompanying drawings, in which some, but not all, example embodiments are shown. Indeed, the examples described and pictured herein should not be construed as being limiting as to the scope, applicability, or configuration of the present disclosure. Like reference numerals refer to like elements throughout.

Any terms used herein referring to a direction or a position relative to the orientation of a safe box, such as but not limited to "vertical," "horizontal," "above," or "below," refer to directions and relative positions with respect to the safe box's orientation as in FIG. 1. Further, the term "or" as used herein is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. The meaning of "in" may include "in," "on," and "at." Phrases such as "in one embodiment" do not necessarily refer to the same embodiment, although they may.

FIG. 1 shows a safe box 10 in accordance with an embodiment of the present invention. In this case, a mounting plate 12 may be interconnected with safe box 10 to mount safe box 10 vertically to a surface. Specifically, mounting plate 12 is first attached to the desired surface, such as a wall or a piece of furniture. After mounting plate 12 is in position, safe box 10 is coupled to it in a manner that prevents its removal unless safe box 10 is opened (i.e., by an authorized person). The contents of safe box 10, however, are fully accessible with the safe box 10 in mounted position.

Figure 2:
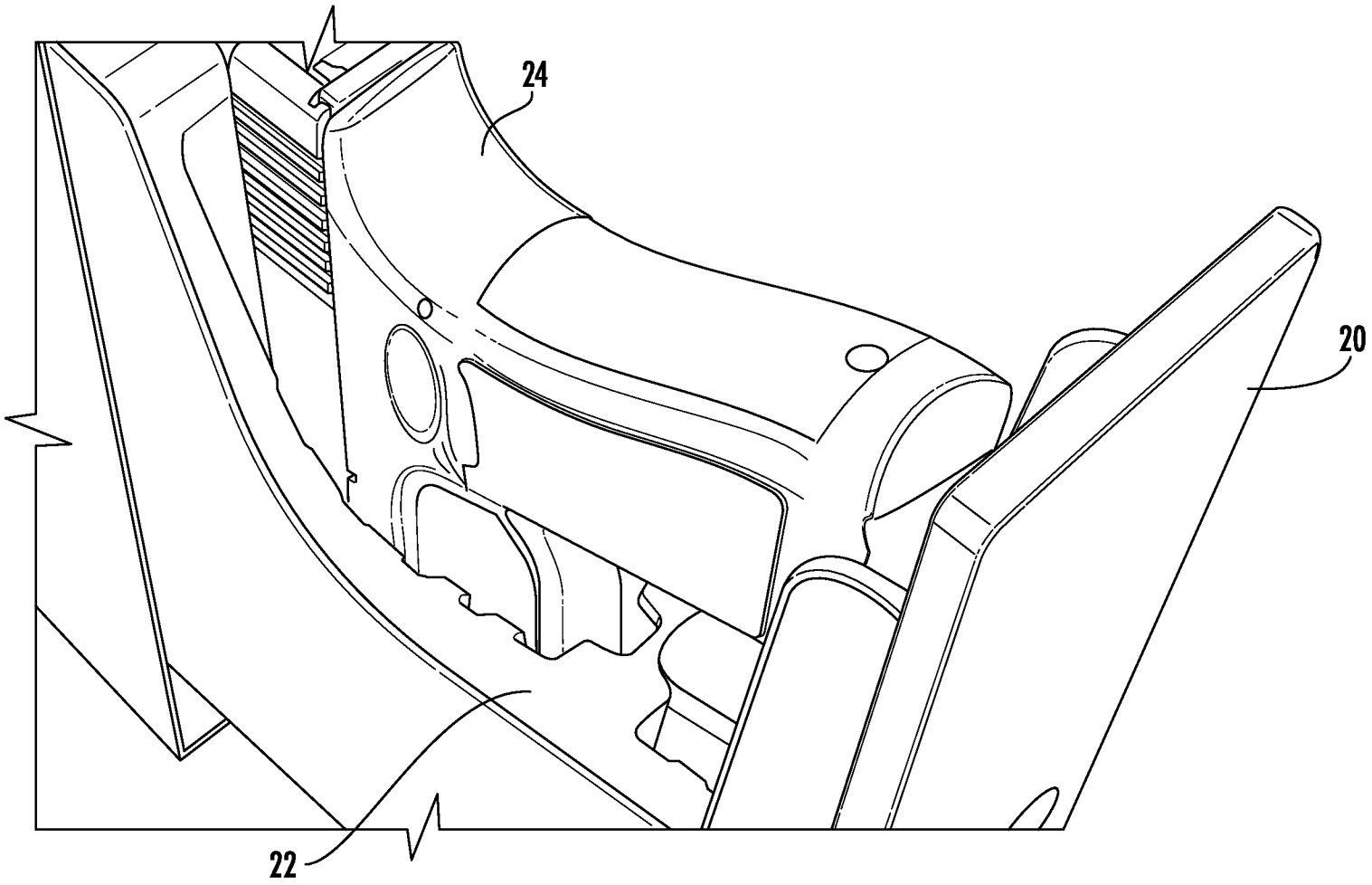
FIG. 2 is a partial perspective view of the slide opening container of the safe box of FIG. 1 opened to show a firearm stored therein.

Safe box 10 has a rectangular housing 14 defining a top side 16, a left side 18, a bottom side, a rear side, and a right side. The top side 16, left side 18, bottom side, rear side, and right side define an opening in which a container 20 is slidably received. Referring now also briefly to FIG. 2, container 20 is movable between a closed position (FIG. 1) preventing access to the interior of the container 20 and an open position (FIG. 2) allowing access to the interior of the container 20. When the container 20 is in the closed position, it forms a front side of the closed, rectangular safe box. When the container 20 is in the open position, anything stored inside the container can be retrieved. In this embodiment, for example, the container has a configured insert 22 (e.g., a foam insert) that is formed to retain a firearm 24 (in this case a handgun).

Referring again to FIG. 1, safe boxes in accordance with the present invention may be locked and unlocked in a number of ways. In the illustrated embodiment, for example, top side 16 of housing 14 has a keypad 26 and a biometric scanner 28. Safe box 10 includes a memory coupled with a processor that are respectively configured to store instructions and detect when either a passcode input via keypad 26 matches a stored passcode or when a received fingerprint scan from biometric scanner 28 matches a stored fingerprint. Upon detection of either condition, the processor is configured to actuate a lock mechanism to release the container 20.

In addition, or in the alternative, safe box 10 may further include a pin tumbler lock. When the tumbler lock receives a matching key in the lock's keyhole, the key orients driver pins to thereby allow the key to turn. When the key is turned, the lock mechanism releases the container 20. Housing 14 includes a movable cover 30 in this embodiment that conceals the keyhole until the user decides to release container 20. In a further embodiment, the safe box includes a mechanical combination lock that allows the lock mechanism to release container 20 when a plurality of rotating disks are properly oriented.

Figure 3:
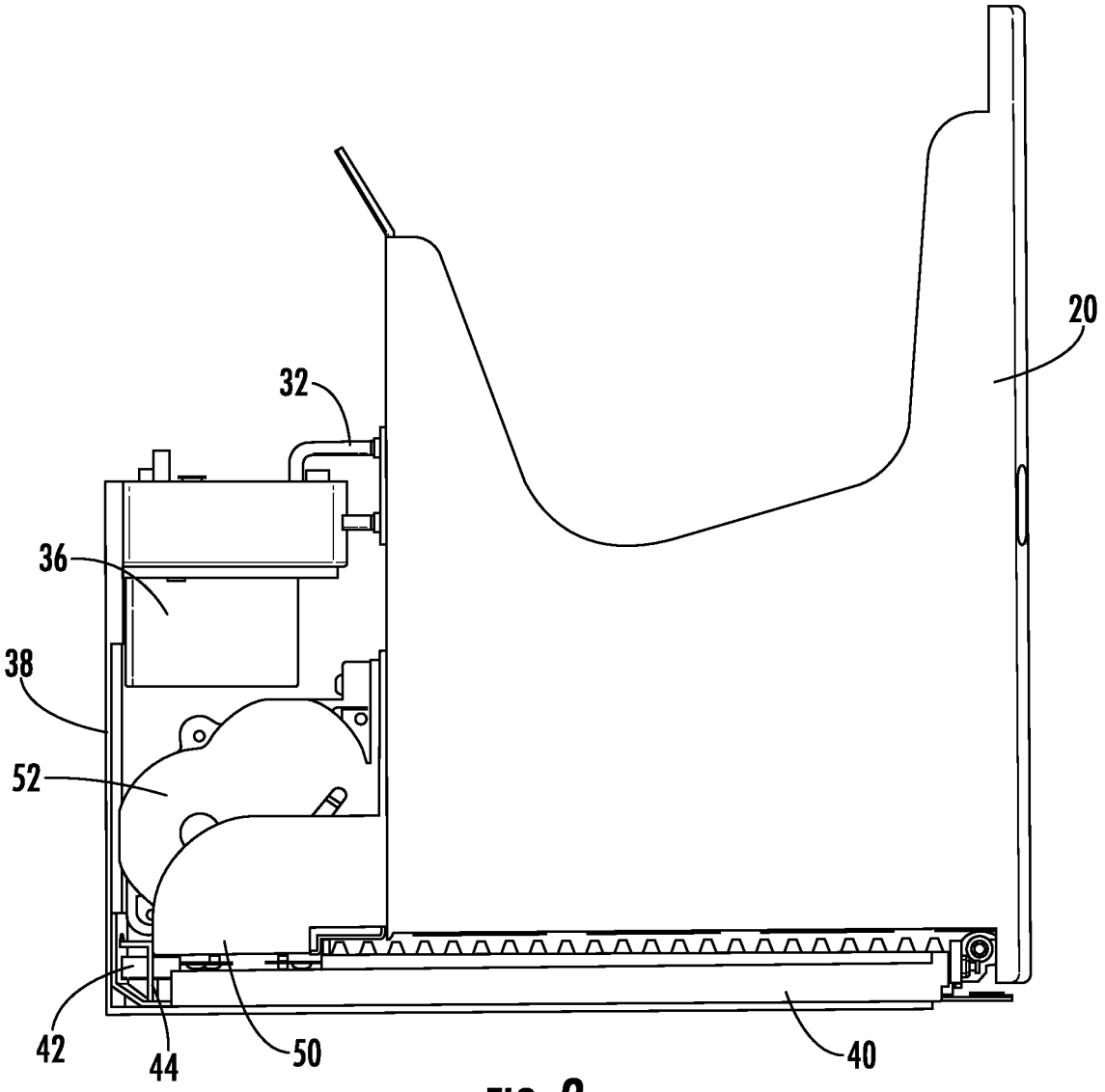
FIG. 3 is a left side elevational view of the slide opening container and a portion of the housing of the safe box of FIG. 1 to reveal certain internal details.
Figure 4:
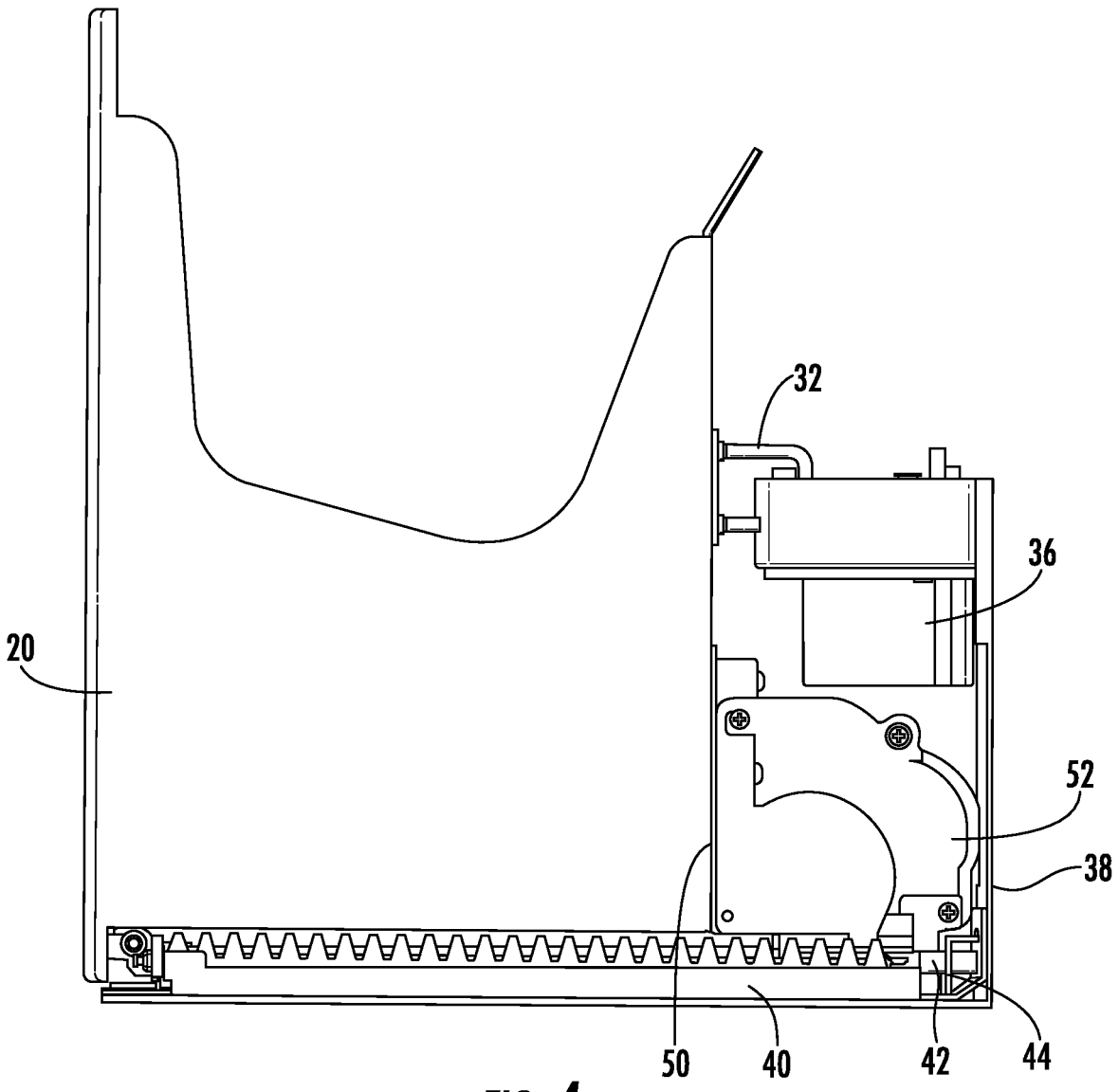
FIG. 4 is a right side elevational view of the components of FIG. 3.
Figure 5:
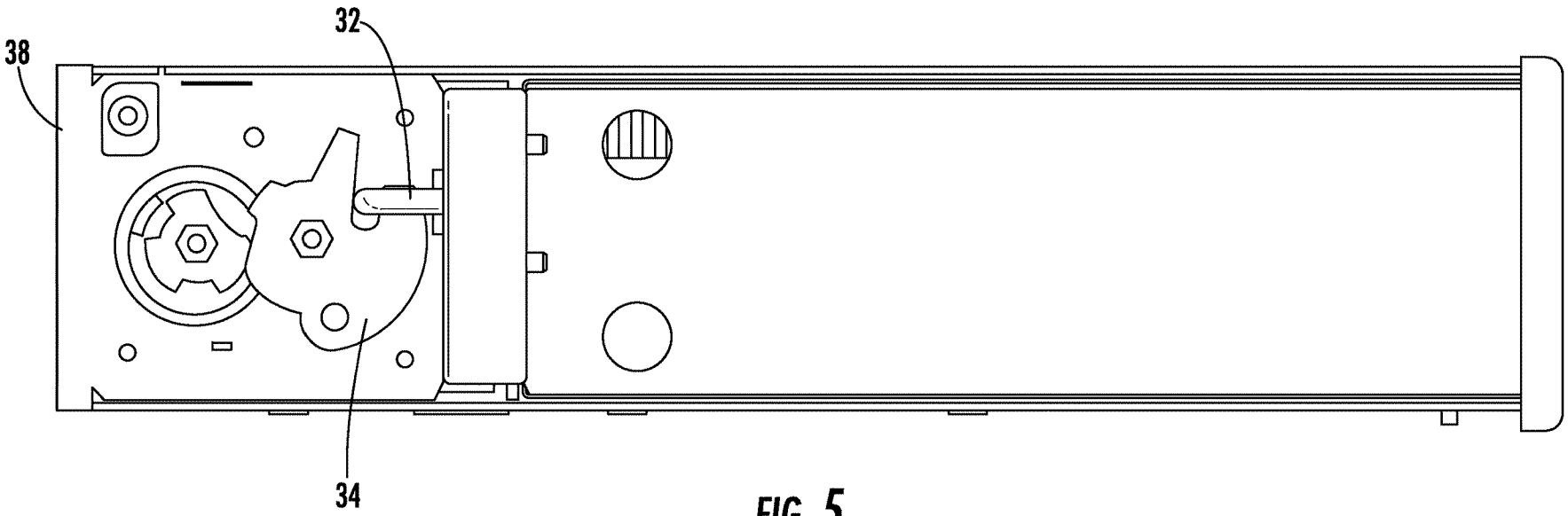
FIG. 5 is a top side elevational view of the components of FIG. 3.

Certain details regarding the construction of safe box 10 can be most easily explained with reference to FIGS. 3-5. In this regard, safe box 10 includes an opening mechanism that operates to automatically move container 20 to the open position when the lock mechanism is released. According to a preferred embodiment, the lock mechanism comprises a generally U-shaped striker 32 mounted to the container 20 that is engaged by a rotary latch 34 fixed with respect to the housing 14. As noted above, latch 34 can be moved to the released position (i.e., the position not engaging striker 32) by operation of the keypad 26 and/or biometric sensor 28. Toward this end, an electrical actuator (e.g., a small stepper motor) 36 may be provided to move latch 34 to the released position. (It will be appreciated that safe box 10 will have a suitable power supply to operate the electrical components, such as one or more batteries.) In addition, a suitable mechanical linkage may be provided to move latch 34 to the released position when a physical key is used. Components of the lock mechanism that remain in fixed position with the respect to housing 14 (i.e., the portions other than striker 32) may be suitably mounted in various ways. For example, these components may be connected directly to housing 14 or may be mounted to a separate base unit 38 which is, in turn, fixed inside of housing 14.

As noted above, when latch 34 of the lock mechanism is moved to the released position, the opening mechanism causes container 20 to move automatically to the open position so that its contents can be accessed. In this embodiment, the opening mechanism utilizes one or more mechanical energy storage elements to effect automatic opening of container 20. When the user pushes container 20 to the closed position, energy is stored. This energy is then used when container 20 is released by the lock mechanism. This allows container 20 open quickly and reliably without the need for battery power to open.

Figure 6:
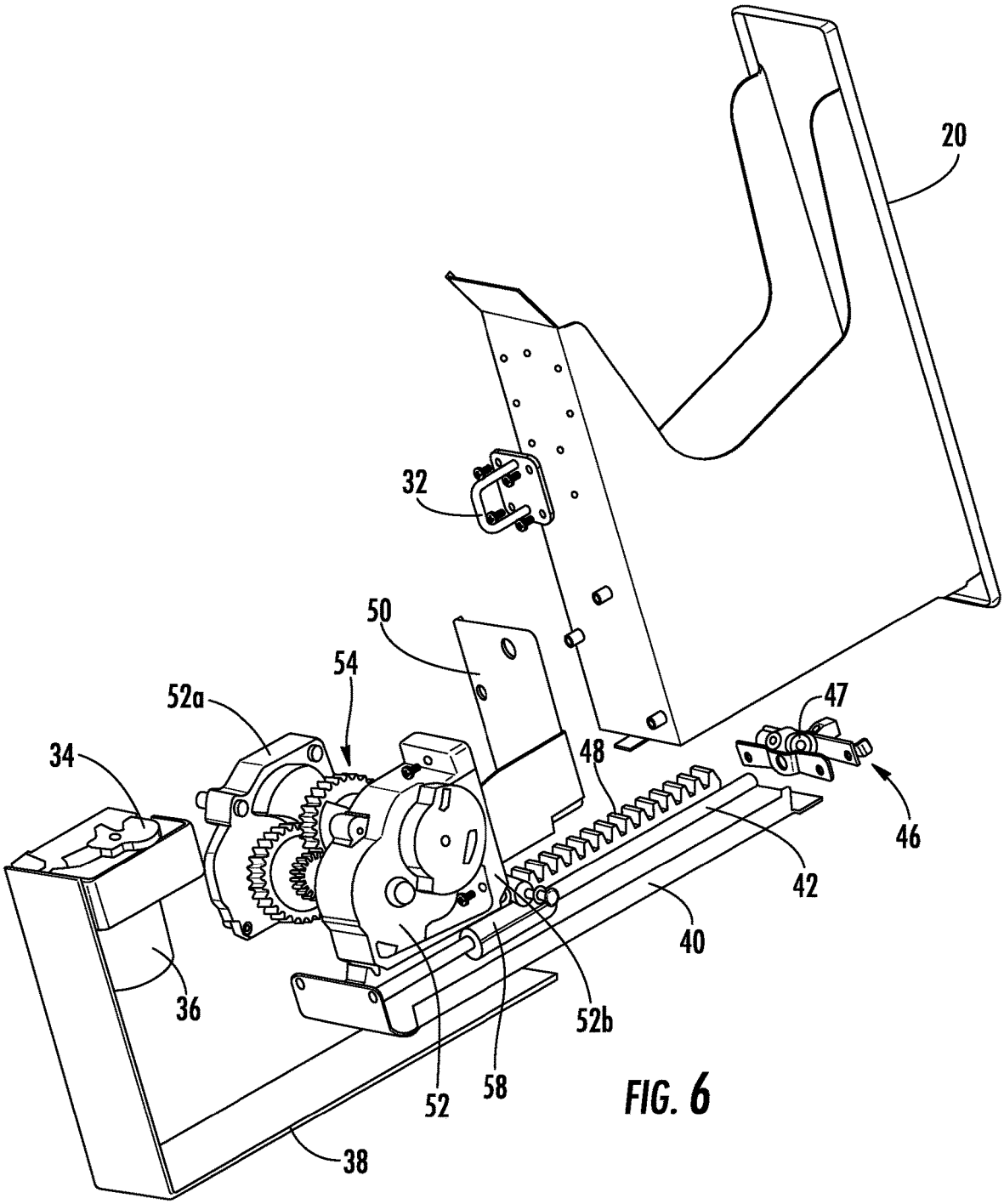
FIG. 6 is an exploded perspective view of the components of FIG. 3.
Figure 7:
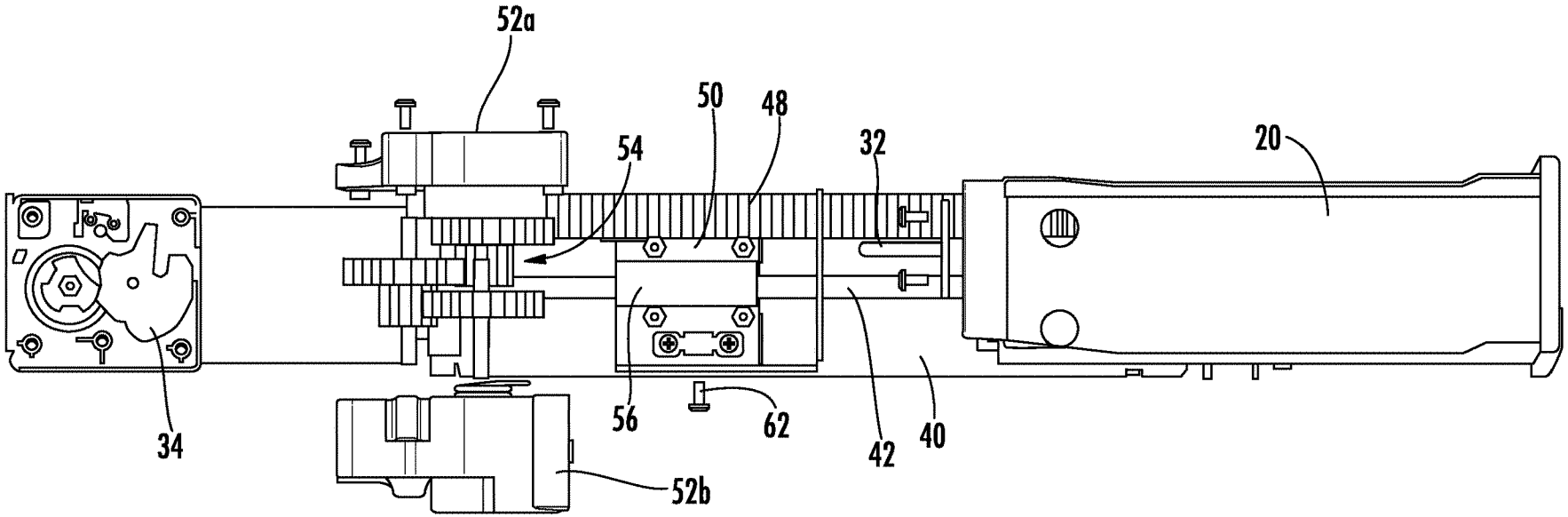
FIG. 7 is a top side exploded plan view of the components of FIG. 3.

Referring now also to FIGS. 6-7, certain details of the opening mechanism will now be described. Various components of the opening mechanism are carried by a slider base 40 which is fixed with respect to base unit 38. Slider base 40 carries a track, here in the form of an elongate rod 42, that extends axially in the direction that container 20 will move. In this case, for example, rod 42 is located below the axial centerline of container 20. In other words, a plane extending vertically and in the direction of the axis of rod 42 would divide container 20 into substantially equal left and right halves. Proximal and distal ends of the rod 42 are supported by proximal and distal frame structures 44 (see FIG. 4) and 46 that are themselves fixed with respect to slider base 40. Frame structure 46 further carries a distal roller 47 that supports the bottom of container 20 as it moves to the open position. A gear rack 48 is mounted to slider base 40 on one lateral side of rod 42 so as to be parallel to rod 42.

Certain components of the opening mechanism move with container 20 as it reciprocates between closed and open positions. The opening mechanism in this embodiment further includes a mounting structure, in the form of a generally L-shaped bracket 50, that is attached to the back of container 20. As shown, one leg of the L of bracket 50 is attached to the back surface of container 20 with the other leg of the L being aligned with the bottom surface of container 20. Bracket 50 carries a gear housing 52 (here having left and right housing portions 52*a* and 52*b*) that contains a gear set 54. Portions 52*a* and 52*b* may be connected together in any suitable way, such as by screws.

Figure 9:
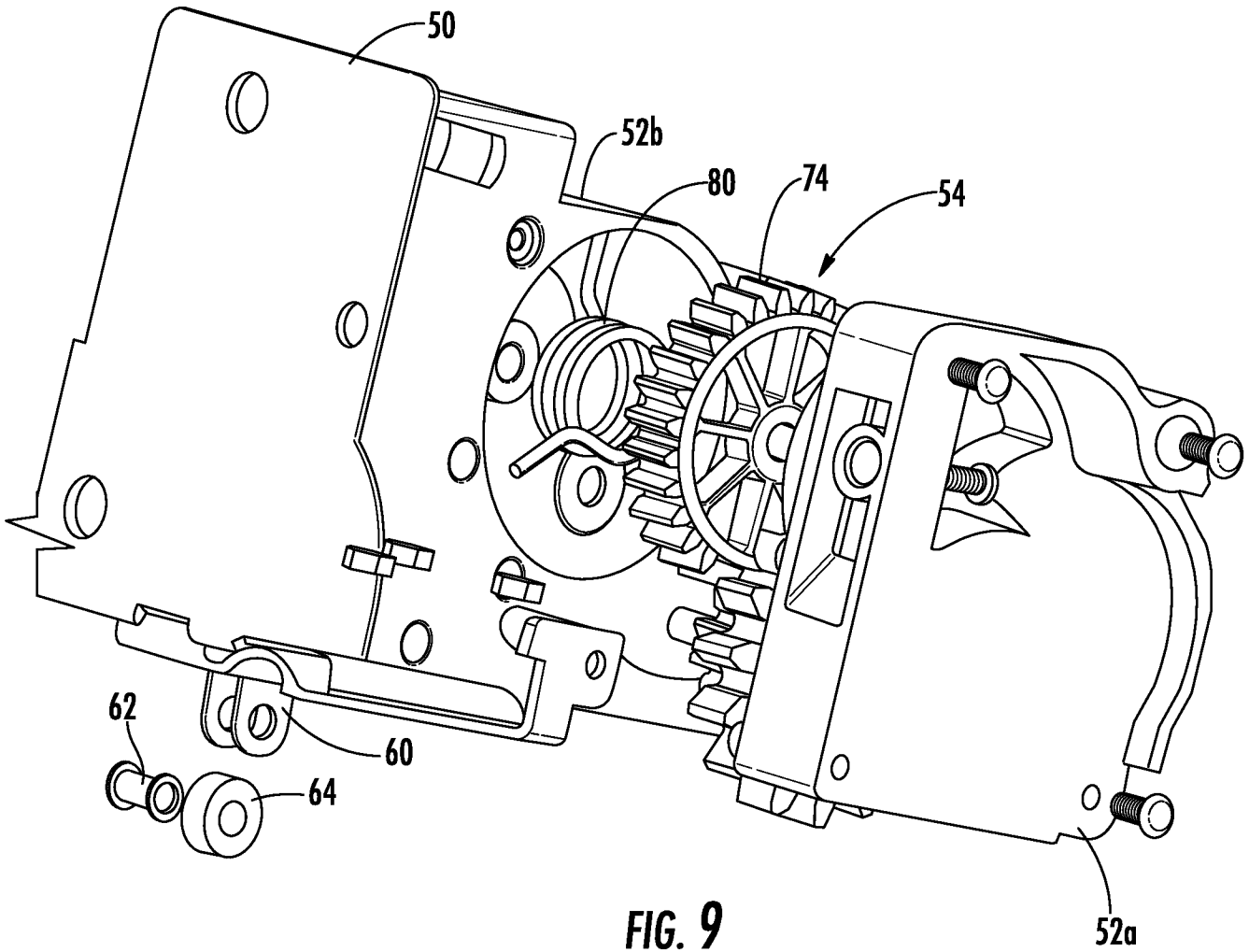
FIG. 9 is an exploded perspective view showing certain details of a gear set and related components in accordance with an embodiment of the present invention.

Bracket 50 further has a cylindrical portion 56 that surrounds rod 42. Cylindrical portion 56 carries a cylindrical bushing 58 through which rod 42 extends. (Cylindrical portion 56 may have upper and lower semi-cylindrical portions that are connected together, such as by screws, to retain bushing 58. As shown in FIG. 9, the upper semi-cylindrical portion may be unitarily formed in this case with the remainder of bracket 50.) Bushing 58, which may be made of any suitable material, such as a low friction polymeric material, acts as a follower to guide container 20 as it moves between the open and closed positions.

In addition, as shown in FIG. 9, bracket 50 may carry a depending roller bracket 60 which supports an axle 62 of a roller 64. Roller 64 is located on the opposite lateral side of rod 42 from gear rack 48 to roll along the inside top surface of slider base 40. As a result, roller 64 will help support container 20 in a vertical orientation during its movement between open and closed positions.

Figure 8:
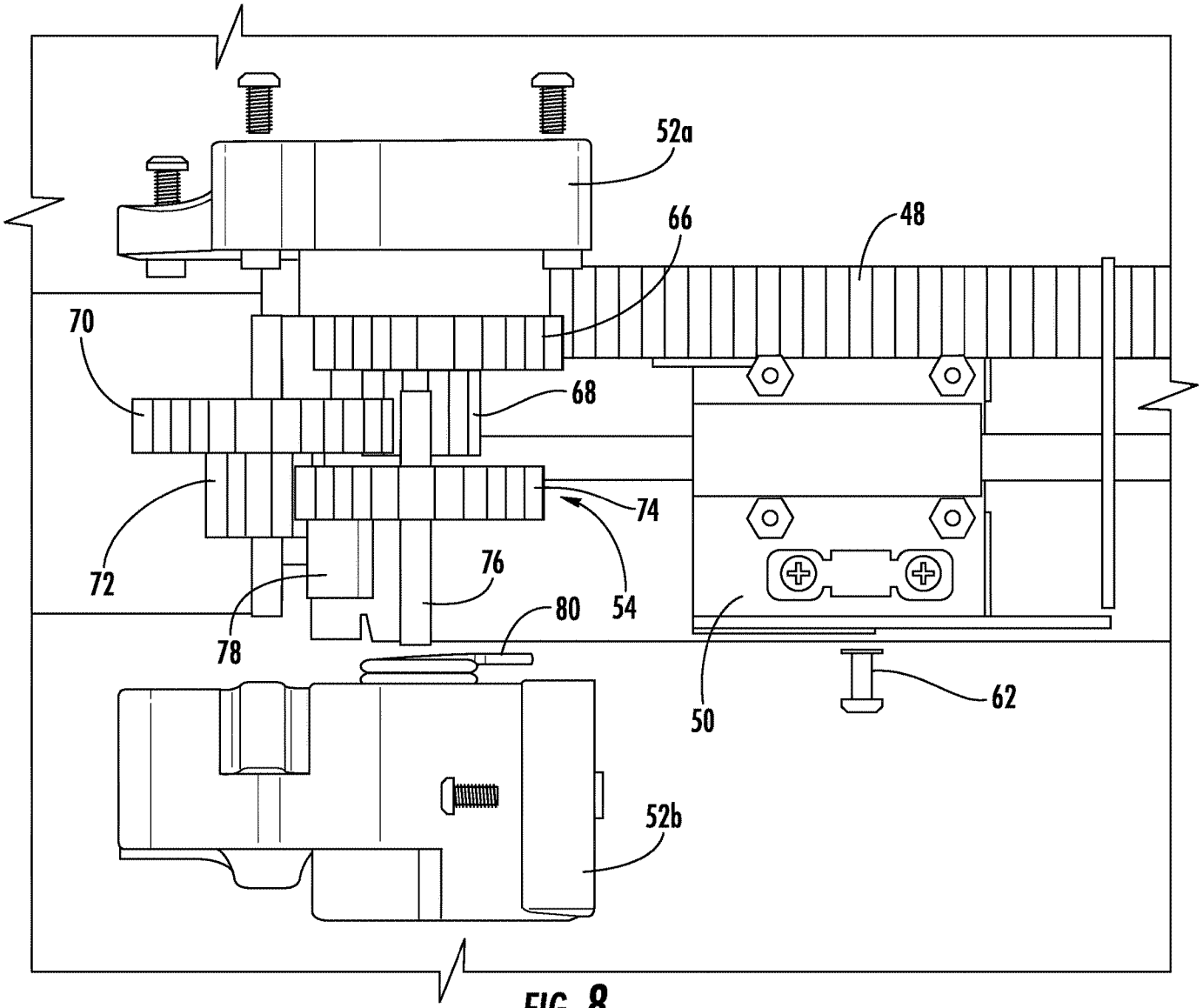
FIG. 8 is an enlarged view of a portion of FIG. 7.

Referring now to FIGS. 8 and 9, the structure and operation of gear set 54 can be most easily explained. In this embodiment, gear set 54 includes a first gear pair having a larger gear 66 and an axially adjacent smaller gear 68 that rotate with each other. The teeth of larger gear 66 are intermeshed with the teeth of gear rack 48. The teeth of smaller gear 68 are intermeshed with the teeth of a larger gear 70 of a second gear pair. The second gear pair also has an axially adjacent smaller gear 72 that rotates with larger gear 70. The teeth of smaller gear 72 are intermeshed with the teeth of a third larger gear 74. The first gear pair, the second gear pair, and third larger gear 74 are supported for rotation in gear housing 52 by respective axles (such as axle 76 of third larger gear 74).

Third larger gear 74 carries an outboard tab 78 that engages one end portion of a torsion spring 80 that extends around axle 76. The other end of torsion spring 80 engages a stop defined in the interior of housing 52*b*. As container 20 is slidably closed by the user, gear set 54 rotates due to engagement of larger gear 66 with gear rack 48. As a result, tab 78 causes spring 80 to wind and store energy. Spring 80 remains in the wound state while container 20 remains closed. When latch 34 of the lock mechanism moves to the released position, spring 80 urges rotation of gear set 54 in the opposite direction. This drives larger gear 66 along gear rack 48, causing container 20 to open quickly.

It can thus be seen that the present invention provides a safe box having a slide opening container with a novel opening mechanism. In the illustrated embodiment, the bottom of the container is maintained in a level orientation by a combination of parallel engagements with a fixed structure (e.g., track, gear rack, and lateral roller). While one or more preferred embodiments of the invention are described above, it should be appreciated by those skilled in the art that various modifications and variations can be made in the present invention without departing from the scope and spirit thereof. Accordingly, it should be understood that the elements of one embodiment may be combined with another embodiment to create a still further embodiment. It is intended that the present invention cover such modifications and variations as come within the scope and spirit of the present disclosure, the appended claims, and their equivalents.

The following is claimed:

1. A firearm safe box comprising:

a housing having sides defining an interior volume and an opening;

a container slidably received in the opening of the housing, the container being movable between a closed position preventing access to the container and an open position allowing access to the container;

the container carrying a configured insert adapted to cradle a firearm;

a lock mechanism operative to retain the container in the closed position; and an opening mechanism operative to automatically move the container to the open position when the lock mechanism is released;

wherein the opening mechanism comprises a plurality of rotary gears forming a gear set driven by an energy storage element;

wherein the energy storage element comprises a torsion spring coaxial with one of the plurality of rotary gears.

2. A firearm safe box comprising:

a housing having sides defining an interior volume and an opening;

a container slidably received in the opening of the housing, the container being movable between a closed position preventing access to the container and an open position allowing access to the container;

the container carrying a configured insert adapted to cradle a firearm;

a lock mechanism operative to retain the container in the closed position; and an opening mechanism operative to automatically move the container to the open position when the lock mechanism is released;

wherein the opening mechanism comprises at least one rotary gear driven by an energy storage element;

wherein the opening mechanism further comprises a gear rack engaging the at least one rotary gear;

wherein the gear rack is fixed with respect to the housing and the at least one gear is connected to the container for movement with respect thereto.

3. A firearm safe box as set forth in claim 2, wherein the opening mechanism further comprises a guide track extending parallel to the gear rack, said guide track being engaged by a follower connected to the container for movement therewith.

4. A firearm safe box as set forth in claim 3, wherein the guide track comprises an elongate rod and the follower includes a cylindrical bushing slidable along the elongate rod.

5. A firearm safe box as set forth in claim 3, further comprising at least one roller connected to said container for movement therewith, said roller engaging and rolling along a fixed surface.

6. A firearm safe box as set forth in claim 5, wherein said at least one roller and said gear rack are mounted on opposite lateral sides of said track.

7. A firearm safe box as set forth in claim 1, wherein:

the housing defines a back side, a top side, a bottom side, a left side, and a right side of the safe box; and the container defines a front side of the safe box when in the closed position.

8. A firearm safe box as set forth in claim 7, wherein said lock mechanism comprises a striker mounted to the container and a rotatable latch mounted in a fixed position relative to the container.

9. A firearm safe box as set forth in claim 1, wherein the lock mechanism is releasable by at least one of a numeric combination, biometric validation, or a key lock.

10. A firearm safe box comprising:

a housing defining a back side, a top side, a bottom side, a left side, and a right side of the safe box, said housing further defining an opening;

a container slidably received in the opening of the housing, the container being movable between a closed position preventing access to the container and an open position allowing access to the container, the container defining a front side of the safe box when in the closed position;

a lock mechanism operative to retain the container in the closed position; and an opening mechanism operative to automatically move the container to the open position when the lock mechanism is released, the opening mechanism including at least one rotary gear driven by an energy storage element and a gear rack engaged with the at least one rotary gear.

11. A firearm safe box as set forth in claim 10, wherein the at least one rotary gear comprises a plurality of rotary gears forming a gear set.

12. A firearm safe box as set forth in claim 11, wherein the energy storage element comprises a torsion spring coaxial with one of the plurality of rotary gears.

13. A firearm safe box as set forth in claim 10, wherein the gear rack is fixed with respect to the housing and the at least one gear is connected to the container for movement with respect thereto.

14. A firearm safe box as set forth in claim 13, wherein the opening mechanism further comprises a guide track extending parallel to the gear rack, said guide track being engaged by a follower connected to the container for movement therewith.

15. A firearm safe box as set forth in claim 14, wherein the guide track comprises an elongate rod and the follower includes a cylindrical bushing slidable along the elongate rod.

16. A firearm safe box as set forth in claim 14, further comprising at least one roller connected to said container for movement therewith, said roller engaging and rolling along a fixed surface.

17. A firearm safe box as set forth in claim 16, wherein said at last one roller and said gear rack are mounted on opposite lateral sides of said track.

18. A firearm safe box as set forth in claim 10, wherein the lock mechanism is releasable by at least one of a numeric combination, biometric validation, or a key lock.

19. A firearm safe box as set forth in claim 2, wherein:

the housing defines a back side, a top side, a bottom side, a left side, and a right side of the safe box; and the container defines a front side of the safe box when in the closed position.

20. A firearm safe box as set forth in claim 19, wherein said lock mechanism comprises a striker mounted to the container and a rotatable latch mounted in a fixed position relative to the container.

21. A firearm safe box as set forth in claim 2, wherein the lock mechanism is releasable by at least one of a numeric combination, biometric validation, or a key lock.

* * * * *